US009016736B1

(12) United States Patent
Anderson

(10) Patent No.: US 9,016,736 B1
(45) Date of Patent: Apr. 28, 2015

(54) FRENCH DOOR LOCK

(76) Inventor: Edward R. Anderson, McLeansville, NC (US)

( * ) Notice: Subject to any disclaimer, the term of this patent is extended or adjusted under 35 U.S.C. 154(b) by 3 days.

(21) Appl. No.: 13/207,682

(22) Filed: Aug. 11, 2011

(51) Int. Cl.

| | |
|---|---|
| ***E05B 15/02*** | (2006.01) |
| *E05C 17/44* | (2006.01) |
| *E05C 17/54* | (2006.01) |
| *E05C 19/18* | (2006.01) |

(52) U.S. Cl.
CPC ..... *E05B 15/0205* (2013.01); *E05C 19/188* (2013.01); *Y10S 292/15* (2013.01); *Y10S 292/21* (2013.01); *Y10S 292/36* (2013.01)

(58) Field of Classification Search
CPC ..... E05C 7/04; E05C 7/06; E05C 9/04
USPC ..... 292/341.18, DIG. 41, DIG. 21, 340, 292/341.17, 288, 289, 338, 339, 342, 343, 292/341.12
See application file for complete search history.

(56) References Cited

U.S. PATENT DOCUMENTS

| | | | | | |
|---|---|---|---|---|---|
| 306,806 | A | | 10/1884 | Barnes | |
| 872,053 | A | * | 11/1907 | Christy | 292/341.18 |
| 1,176,457 | A | * | 3/1916 | Jones et al. | 292/76 |
| 1,238,924 | A | | 9/1917 | Kennedy | |
| 1,534,584 | A | * | 4/1925 | Fredrick | 70/145 |
| 1,863,487 | A | | 6/1932 | Russell | 292/346 |
| 2,003,856 | A | * | 6/1935 | Gimbel | 292/288 |
| 2,034,570 | A | * | 3/1936 | Flavin | 292/65 |
| 2,065,732 | A | * | 12/1936 | Peace | 292/341.18 |
| 2,127,891 | A | | 8/1938 | Starling | 292/341.18 |
| 2,172,610 | A | * | 9/1939 | Frank | 292/288 |
| 2,202,916 | A | * | 6/1940 | Mussa | 292/177 |
| 2,486,772 | A | | 11/1949 | Wuerl | 292/341.18 |
| 2,523,952 | A | * | 9/1950 | Heinen | 292/341.18 |
| 2,726,892 | A | | 5/1954 | Zynda et al. | 292/341.14 |
| 2,781,219 | A | * | 2/1957 | Bahorik | 292/341.18 |
| 3,007,732 | A | | 3/1959 | Schlage | 292/341.12 |
| 3,054,632 | A | * | 9/1962 | Welch | 292/288 |
| 3,241,873 | A | * | 3/1966 | Russell et al. | 292/340 |
| 3,316,007 | A | | 4/1967 | Russell | 292/341.12 |
| 3,524,669 | A | | 8/1970 | Reid | 292/346 |
| 3,792,893 | A | | 2/1974 | Grotnes | 292/256.61 |
| 3,939,752 | A | | 2/1976 | Koscik | 85/5 R |
| 3,963,269 | A | | 6/1976 | Rosenberg | 292/346 |
| 4,012,065 | A | * | 3/1977 | Miller | 292/288 |
| 4,045,065 | A | | 8/1977 | Johnson | 292/341.17 |
| 4,074,484 | A | | 2/1978 | Queren | 52/214 |
| 4,105,235 | A | | 8/1978 | Thiel | 292/341.18 |
| 4,183,568 | A | * | 1/1980 | Ferracane | 292/341.18 |
| 4,195,870 | A | | 4/1980 | Percoco | 292/340 |
| RE30,326 | E | | 7/1980 | van Buren, Jr. | 220/326 |
| 4,223,494 | A | | 9/1980 | Wendt | 52/211 |
| 4,281,480 | A | | 8/1981 | Wendt | 49/504 |
| 4,416,087 | A | | 11/1983 | Ghatak | 49/462 |
| 4,438,597 | A | | 3/1984 | Maggart | 49/501 |
| 4,489,517 | A | | 12/1984 | Young | 49/382 |
| D283,299 | S | | 4/1986 | Mazie | D8/343 |
| 4,631,866 | A | | 12/1986 | Otto et al. | 49/504 |

(Continued)

*Primary Examiner* — Kristina Fulton
*Assistant Examiner* — Faria Ahmad

(57) ABSTRACT

French doors that include a passive door and an active door are kept closed by a plate on a trim over a French door jamb having a flange at one of the sides. Holes in the plate allow it to be screwed into the trim. The flange retains the passive French door in place, but the screw in the hole over the active door can be removed to allow the plate to pivot about the remaining screw so the plate can be bent upward to allow the passive door to open under the flange.

19 Claims, 6 Drawing Sheets

(56) References Cited

U.S. PATENT DOCUMENTS

| | | | | | |
|---|---|---|---|---|---|
| 4,635,399 | A | | 1/1987 | Gehrke et al. | 49/460 |
| 4,673,204 | A | | 6/1987 | Allenbaugh | 292/346 |
| 4,690,445 | A | | 9/1987 | Hartley | 292/341 |
| 4,717,185 | A | | 1/1988 | Hartley | 292/340 |
| 4,720,129 | A | | 1/1988 | Bouchard | 292/346 |
| 4,858,384 | A | | 8/1989 | Blankenship | 49/460 |
| 5,005,881 | A | * | 4/1991 | Bailey et al. | 292/45 |
| 5,070,650 | A | | 12/1991 | Anderson | 49/460 |
| 5,094,489 | A | | 3/1992 | Jones | 292/340 |
| 5,171,050 | A | * | 12/1992 | Mascotte | 292/341.18 |
| 5,241,790 | A | | 9/1993 | Schimpf | 49/504 |
| 5,288,257 | A | * | 2/1994 | Zacherl | 446/72 |
| 5,382,060 | A | * | 1/1995 | O'Toole et al. | 292/46 |
| 5,456,507 | A | | 10/1995 | Jones | 292/349 |
| 5,474,347 | A | | 12/1995 | Vigneault et al. | 292/340 |
| D372,191 | S | | 7/1996 | Bennett | D8/403 |
| 5,566,509 | A | | 10/1996 | Long | 49/462 |
| 5,566,995 | A | | 10/1996 | Jagiela | 292/346 |
| D375,446 | S | | 11/1996 | Nelson | D8/343 |
| 5,581,948 | A | | 12/1996 | Simonsen | 49/460 |
| 5,640,808 | A | | 6/1997 | Simeone et al. | 49/504 |
| 5,645,330 | A | | 7/1997 | Artwohl et al. | 312/115 |
| 5,915,764 | A | | 6/1999 | MacDonald | 292/66 |
| 5,934,024 | A | | 8/1999 | Simpson | 49/462 |
| 6,085,465 | A | | 7/2000 | Olberding et al. | 49/460 |
| 6,149,209 | A | * | 11/2000 | Barton | 292/67 |
| 6,176,527 | B1 | | 1/2001 | Bench | 292/340 |
| 6,185,881 | B1 | | 2/2001 | Olberding et al. | 52/294.1 |
| 6,305,127 | B1 | | 10/2001 | Olberding et al. | 49/461 |
| 6,679,004 | B1 | | 1/2004 | Olberding et al. | 49/460 |
| 6,691,466 | B2 | | 2/2004 | Childress | 49/462 |
| 6,698,807 | B1 | | 3/2004 | Wacker | 292/341.14 |
| 6,834,897 | B1 | | 12/2004 | Walker | 292/340 |
| 6,901,706 | B2 | | 6/2005 | Olberding et al. | 49/460 |
| 7,000,959 | B2 | | 2/2006 | Sanders | 292/340 |
| 7,331,617 | B2 | * | 2/2008 | Johnson | 292/202 |
| 7,494,163 | B2 | * | 2/2009 | Monts de Oca | 292/143 |
| D635,453 | S | * | 4/2011 | Giles | D8/402 |
| 8,132,832 | B2 | * | 3/2012 | Anderson | 292/340 |
| 2005/0046201 | A1 | * | 3/2005 | Patire et al. | 292/289 |
| 2006/0157991 | A1 | * | 7/2006 | Nguyen | 292/341.18 |
| 2006/0214437 | A1 | | 9/2006 | Farzan | 292/340 |
| 2007/0040397 | A1 | * | 2/2007 | Nicholas et al. | 292/341.18 |
| 2008/0224486 | A1 | | 9/2008 | Anderson | 292/340 |
| 2008/0284182 | A1 | | 11/2008 | Canerdy, Jr. | 292/346 |
| 2010/0269431 | A1 | * | 10/2010 | Young | 52/204.1 |

* cited by examiner

FRENCH DOOR LOCK

BACKGROUND OF THE INVENTION

Most doors used in construction today are of the "pre-hung" type. More particularly, the door and door frame are prefabricated and are sold as a unit. The entire door and door frame unit is then installed by the purchaser. A large percentage of these pre-hung doors are made of wood and are installed as entry doors. While entry doors especially French doors are intended to function to exclude uninvited guests when locked, they are often inadequate for that purpose.

Unfortunately, even when lock sets and deadbolts are used, it can be relatively easy for an intruder, such as a burglar, to gain entry to the dwelling or business by forcefully kicking the door in the general vicinity of the door lock latch bolt and/or the deadbolt latch bolt, thereby breaking the door jamb where the strike plates are located and allowing the door to be opened. That problem is addressed by prior products of the applicant described in U.S. Pat. No. 5,070,650 and published application 2008/0224486, the entire disclosures of which are incorporated herein by reference.

A particularly vulnerable type of door is a French door which includes two pivoting doors that come together and together at a central closure for one another. Commonly, such French doors have the usual latch bolt and perhaps a deadbolt and a mechanism to actuate a slide bolt through the top of a passive door to protrude a slide bolt into an opening in the trim of the door frame at the top of the door. This provides some strength to the door to keep it closed and house properly within the door frame. However, it has been found that such doors continue to have weakness, and are particularly vulnerable to an intruder kicking at the door. Provisions like those set forth above can be used to reinforce the connection between the two doors, but there is still a weakness in the connection of the doors to the frame. This results in the continuing vulnerability for such French doors.

SUMMARY OF THE INVENTION

The present invention fulfills one or more of these needs in the art by providing an apparatus for helping keep a pair of French doors that include a passive door and an active door closed. A substantially rectangular plate, typically metal, has a width from side to side narrow enough to fit on a trim over a French door and a length between two ends of the plate substantially longer than the width. The plate of metal has a perpendicular flange at one of the sides, the flange being unitary with the plate and extending from the plate at least ½ inch. Holes in the plate near each end of the plate are further from the side having the flange than the other side. The plate can be affixed to a trim over French doors at a location where the flange contacts the passive door but not the active door and each hole in the plate is located above one of the French doors, by screws through the holes into the trim. This keeps the plate in place and its flange retains the passive French door in place. The screw in the hole over the active door can be removed to allow the plate to pivot about the remaining screw so the plate can be bent upward to allow the passive door to open under the flange.

Preferably, the plate has rounded corners where the ends and the side that does not have the flange intersect, enabling the plate to turn without striking a vertical trim piece depending from the trim to which the plate is affixed when the plate pivots.

Typically, the plate has at least one slide lock bolt receiving aperture. More preferably, the plate has at least two slide lock bolt receiving apertures. In a preferred embodiment, the plate is a foot long, the flange is positioned centered along the length of the plate and each slide lock bolt receiving aperture is positioned so it has an edge 3½ inch from a plate end. The slide lock bolt receiving apertures may include plugs held in place by connectors that are relatively easy to break. Desirably, the holes are countersunk so that screws holding the plate against the trim do not impede closure of the doors.

In a preferred embodiment the plate is a foot long and the flange is about four inches long and is positioned centered along the length of the plate. Desirably, the flange extends from the plate ¾ inch.

The invention can also be considered as a method of helping keep a pair of French doors that include a passive door and an active door closed. The method includes fastening an end of a metal plate on a trim over a French door so that a flange on the plate extends down from the trim by at least ½ inch at a location where the flange contacts the passive door but not the active door. The method includes closing the passive door while bending the plate upward so the closing passive door passes under the flange. Then the plate is pivoted about the fastener of the plate to the trim until the flange contacts the passive door and a hole in the plate is adjacent the trim. A screw is next passed through the hole into the trim. The active door can be opened and closed without interaction with the plate, and its screw can be removed to allow the plate to pivot about the fastener and bent upward to allow the passive door to open under the flange.

The method can include a preliminary step of removing an existing striker plate from the trim. In the method, fastening the metal plate on the trim may include positioning the plate so a hole in the plate aligns with a hole in the trim to receive a slide lock bolt. Fastening an end of a metal plate on the trim may include passing a screw through a hole in the plate and into the trim.

Fastening the metal plate on a trim may include positioning the metal plate so a slide lock bolt receiving aperture in the metal plate is aligned with a slide lock receiving hole in the trim. The method may include removing a plug from the slide lock bolt receiving aperture in the metal plate by breaking connectors holding the plug in the aperture.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
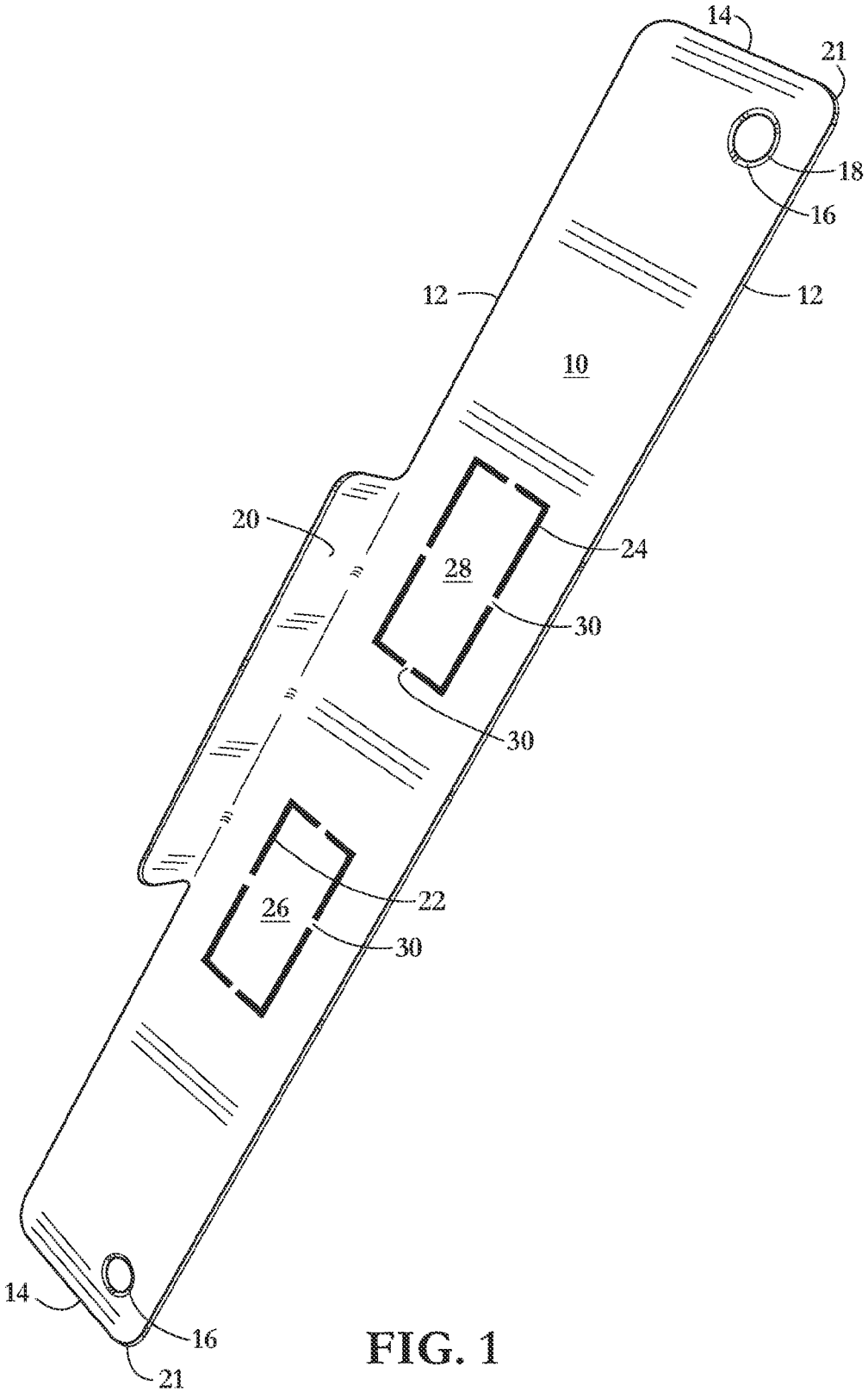
FIG. 1 is a perspective view of a French door lock in accordance with an embodiment of the invention.

As seen in FIG. 1, the French door lock includes a plate 10 made of a sturdy metal, such as steel. The plate 10 can be powder coated to inhibit corrosion and for aesthetics. Other materials with sufficient strength can be used. The plate 10 has two long sides 12 defining a width and two ends 14 defining a length. Depending from one of the sides 12 is a flange 20 that extends at a 90 degree angle from the plate 10. Each end of the plate 14 is provided with a hole 16 further from the side of the plate having a flange 20 then the other side 12. Preferably, the hole is countersunk as at 18. The corners 21 of the plate 10 at the intersection of the side further from the flange with each of the ends is provided in a rounded fashion allowing the plate 10 to pivot as needed. Both ends are rounded so that pivoting about either of the holes 16 can be accommodated. The other corners are similarly rounded in the embodiment of FIG. 1, but need not be so rounded.

The plate 10 has two cut out areas 22, 24 positioned at places in the plate 10 where the slide bolt is likely to pass through the plate 10 into the frame of the door. Typically, only one of the two apertures will be opened by breaking its corresponding connectors 30. Thus, when the lock is being installed, the knock-out or plug 26, 28 which needs to be cleared to allow the slide bolt to pass through can be opened by simply breaking the connectors 30 for the selected hole.

In the embodiment of FIG. 1, the plate 10 is 12" long×1¾" wide. The flange 20 is preferably 4" long×¾" wide, with four inches of plate 10 on either side of the flange. The holes in the plate are centered 1¼" from the side with the flange and ½ inch from the side without the flange. The hole is centered ½ inch from the end of the plate. Each knock out 22, 24 has an edge 3½ inch from a plate end 14 and each knockout 22, 24 is 1¾ inch long. Each knock out 22, 24 has an edge ½ inch from a plate side 12 and each knockout is ¾ inch wide.

The plate 10 includes at least one second cut out area defining at least one slide lock bolt receiving aperture 22 or 24. In various exemplary embodiments, the plate 10 includes at least two slide lock bolt receiving apertures 22, 24. In these exemplary embodiments, the slide lock bolt receiving apertures 22, 24 are formed at an appropriate location so as to be able to receive a slide lock bolt within the slide lock bolt receiving aperture 22, 24, whether installed on a right-handed active door or a left-handed active door.

As shown in FIG. 1, the plate 10 may optionally be supplied with one or more optional slide lock bolt receiving aperture plugs 26, 28. If included, the slide lock bolt aperture plugs 26, 28 can be left in place to fill in any of the slide lock bolt receiving aperture that will not be utilized.

The slide lock bolt receiving aperture plug(s) 26, 28 may be held in place by, for example, a plurality of connectors 30 that are relatively easy to break. The space that a slide lock bolt receiving aperture plug 26, 28 does not fill within a slide lock bolt receiving aperture can be filled in, if desired, with caulk, putty (or the like) upon completion of installation of the French door lock.

Figure 2:
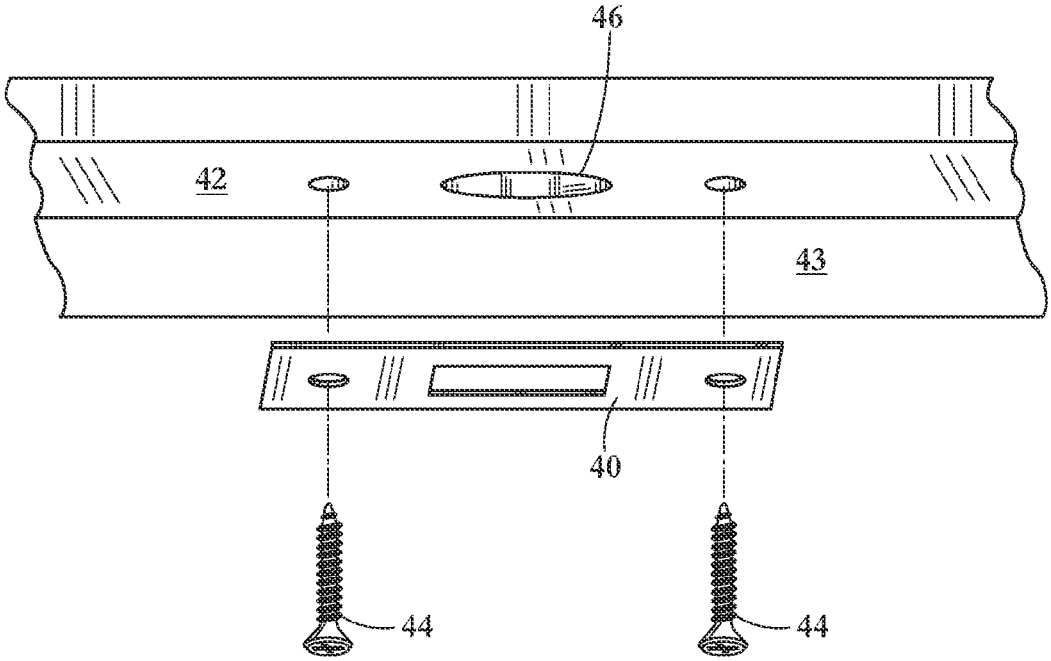
FIGS. 2-5 illustrate steps used to install the embodiment on FIG. 1 on a pair of French doors.

As seen in FIG. 2, the installation of the French door lock on an existing French door installation that has French doors that swing inwardly to open. When closed, they bear against a door frame trim element 43. The process includes removal of screws 44, which enables the removal of an existing striker plate 40 from the door frame trim 42. This exposes the recess 46 in the door frame 42 that has received the slide bolt. The hole 46 will continue to receive the slide bolt in the use of the preferred embodiments of the invention.

Figure 3:
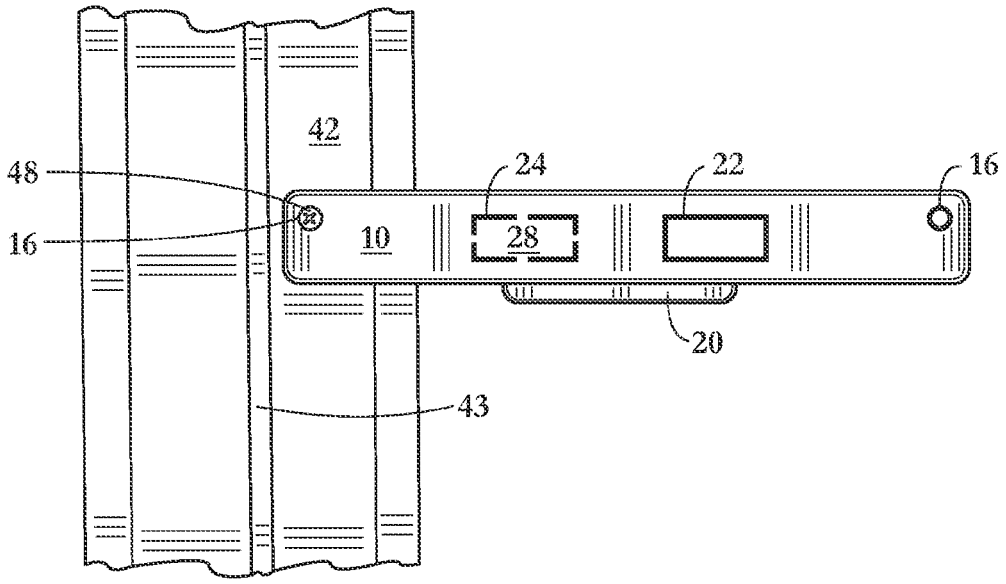

As seen in FIG. 3, the plate 10 can be affixed to the door frame trim by passing a screw 48 through hole 16 into the door frame trim 42. The positioning of the plate 10 on the door frame 42 is selected so that the flange 20 will bear against the passive, but not the active door, and so that one of the slide bolt receiving apertures is aligned with the slide bolt recess in the door frame. In this case, the aperture 22 is selected for this purpose and has, in the view of FIG. 2, had its plug 30 removed. The plug 28 remains in the other aperture 24. The installation seen in FIG. 3 is performed with both of the doors open.

Figure 4:
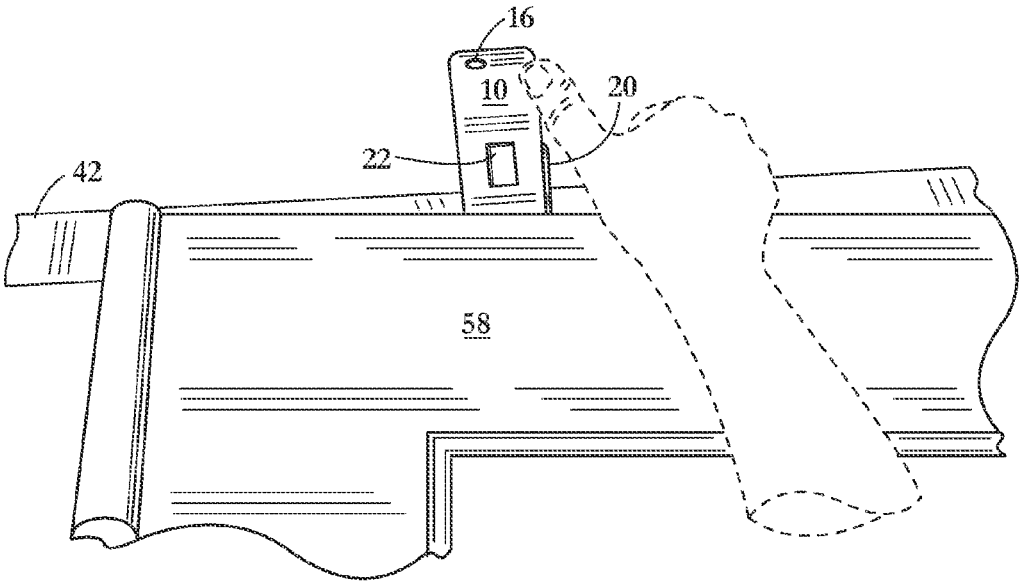

As seen in FIG. 4, the passive door can then be brought to closure by bending the plate 10 upwardly, so that the passive door passes under the flange 20. The plate 10 maintains enough resilience to return to its position. Upon completing the closure of the passive door 4, the plate 10 can then be pivoted to the position seen in FIG. 5. In this position, the passive door is closed against a door trim element, and the plate 10 is aligned underneath of the door frame trim 42, causing the flange 20 to bear against the closed passive door. In this position, the aperture 22 is aligned with the hole 46 in the door frame trim, although not visible in FIG. 5.

Figure 5:
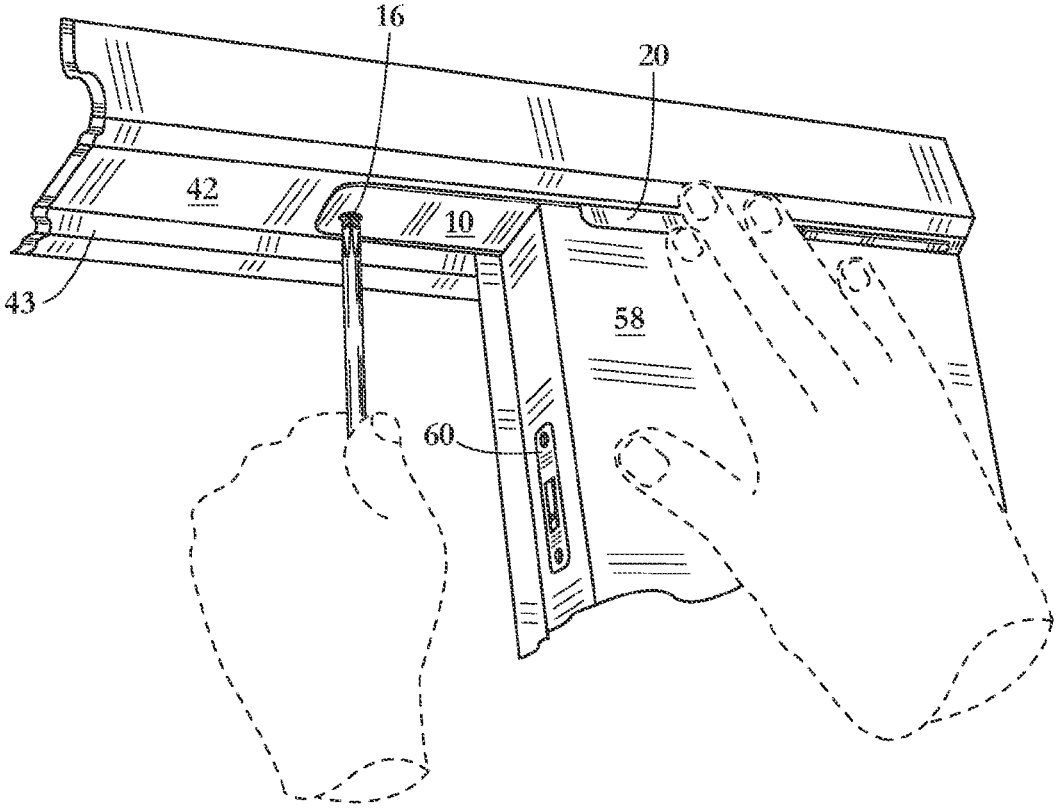

Then, as seen in FIG. 5, a mark can be made in the hole 16 for a second screw to be inserted through the plate 10 into the door frame 42 securely holding the plate 10 against the underside of the door frame trim 42. Not seen in FIG. 5 is the slide bolt aperture 42, but it is positioned above the passive door 58 and its slide bolt actuator 60. Thus, slide bolt engages through the plate 10 and into the door frame trim 42 providing a connection to the door frame, reinforced by the flange 20 which holds the passive door 58 closed. The active door, not seen in FIG. 5, can then be closed in conventional fashion, passing under the plate 10 without inhibition. As mentioned, the holes 16 are countersunk as at 18, so that screws do not impede the closure of either door. Where it is desired to open the passive door, the active door can be opened and the screw in the plate 10 above the active door can be removed. Then, the passive door 58 can be bumped open to dislodge the plate 10, allowing it to pivot back to the position shown in FIG. 4. The plate 10 can then be bent upwardly to allow the passive door to open underneath the flange 20.

While various sizes are recited in the foregoing description of the preferred embodiment, variations in the sizes can be contemplated within broad definition of the invention. Also, although the plate is described as metal, in some cases other materials may be used if they have sufficient strength.

The plate is shown having a central flange 20, with flangeless ends. This permits the French door lock to be mounted on a French door, regardless of whether the passive door is on the right or the left. The invention also contemplates embodiments in which the flange extends to one end. For instance, if it extends to the left end, that embodiment would mount to French doors that have the left door as passive.

Figure 6:
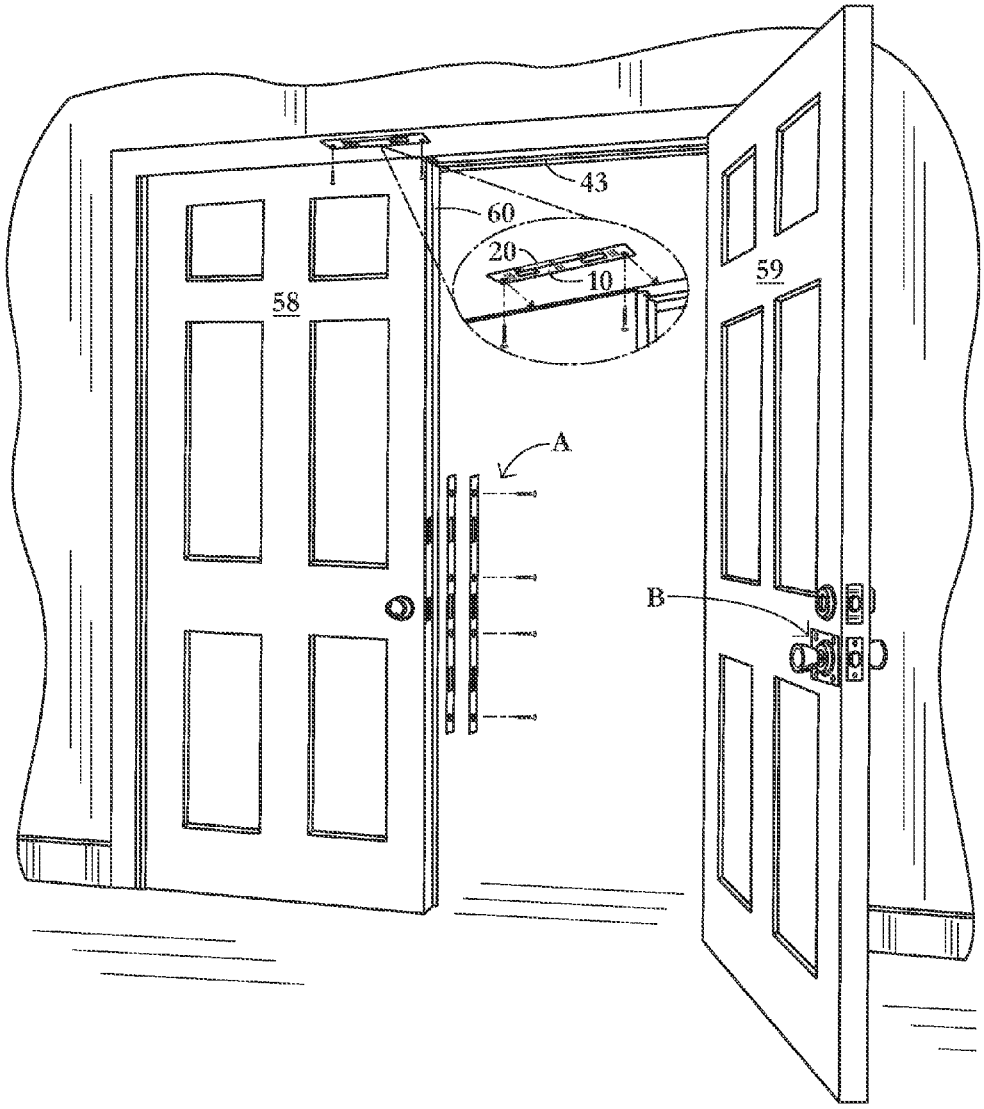
FIG. 6 is a perspective view of a French double door with the embodiment of FIG. 1 installed, together with other security-enhancing aids, partially exploded.

As seen in FIG. 6 when the plate 10 and its flange 20 are installed, particularly with additional door strengthener having elements such as these in the afore-mentioned U.S. Pat. No. 5,070,650, published application no. 2008/0224486 (Item A in FIG. 6) and pending U.S. patent application Ser. No. 13/198,077, filed Aug. 4, 2011 (The entire disclosure of which is hereby incorporated herein by reference) (Item B in FIG. 6), the door survives numerous vigorous kick attempts without breaking. The device of U.S. patent application Ser. No. 13/198,077 is suitably mounted on the active door 59 of the French door pair.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus for helping keep a pair of French doors that include a passive door and an active door closed comprising a substantially rectangular plate of a width from side to side mounted on a trim at the top of a French door and a length between two ends of the substantially rectangular plate substantially longer than the width, the substantially rectangular plate having a perpendicular flange at one of the sides, the flange being unitary with the substantially rectangular plate and extending from the substantially rectangular plate at least ½ inch, the flange having a length in a direction parallel to the length of the substantially rectangular plate that is shorter than the substantially rectangular plate and positioned centered along the length of the substantially rectangular plate, a hole in the substantially rectangular plate near each end of the substantially rectangular plate, the holes being further from the side having the flange than the other side, the substantially rectangular plate being configured in a size and shape that enables the substantially rectangular plate to be affixed to the inside face of a trim in the gap above French doors at a location where the flange prevents opening the passive door but not the active door and each hole in the substantially rectangular plate is located above each one of the French doors by screws through the holes into the trim, keeping the substantially rectangular plate in place and its flange retaining the passive French door in place, but the screw in the hole above the active door can be removed to allow the substantially rectangular plate to pivot about the remaining screw in the hole above the passive door so the substantially rectangular plate can be bent upward above the top edge of the passive door to allow the passive door to open under the flange.

2. An apparatus as claimed in claim 1 wherein the substantially rectangular plate has rounded corners where the ends and the side that does not have the flange intersect, enabling the substantially rectangular plate to turn without striking a vertical trim piece depending from the trim to which the substantially rectangular plate is affixed when the substantially rectangular plate pivots.

3. An apparatus as claimed in claim 1 wherein the substantially rectangular plate has at least one slide lock bolt receiving aperture.

4. An apparatus as claimed in claim 1 wherein the substantially rectangular plate has at least two slide lock bolt receiving apertures.

5. An apparatus as claimed in claim 4 wherein the substantially rectangular plate is a foot long, the flange is positioned centered along the length of the substantially rectangular plate and each slide lock bolt receiving aperture is positioned so it has an edge 3½ inches from a substantially rectangular plate end.

6. An apparatus as claimed in claim 4 wherein the slide lock bolt receiving apertures include plugs held in place by connectors that are relatively easy to break.

7. An apparatus as claimed in claim 1 wherein the holes are countersunk so that screws holding the substantially rectangular plate against the trim do not impede closure of the doors.

8. An apparatus as claimed in claim 1 wherein the substantially rectangular plate is a foot long and the flange is about four inches long and is positioned centered along the length of the substantially rectangular plate.

9. An apparatus as claimed in claim 1 wherein the flange extends from the substantially rectangular plate ¾ inch.

10. An apparatus as claimed in claim 1, wherein the substantially rectangular plate and flange are metal.

11. A method of helping keep a pair of French doors that include a passive door and an active door closed comprising fastening an end of a substantially rectangular plate on the inside face of a trim in the gap above each French door so that a flange on the substantially rectangular plate extends down from the trim by at least ½ inch at a location where the flange prevents opening the passive door but not the active door, closing the passive door while bending the substantially rectangular plate upward so the closing passive door passes under the flange, allowing the substantially rectangular plate to resiliently return toward its unbent position, pivoting the substantially rectangular plate about the fastener of the substantially rectangular plate to the trim until the flange contacts the passive door and a hole in the substantially rectangular plate is adjacent the trim, passing a screw through the hole into the trim, whereby the active door can be opened and closed without interaction with the substantially rectangular plate and the screw over the active door can be removed to allow the substantially rectangular plate to pivot about the fastener in the hole above the passive door and bent upward above the top edge of the passive door to allow the passive door to open under the flange.

12. A method as claimed in claim 11 further comprising a preliminary step of removing an existing striker plate from the trim.

13. A method as claimed in claim 11 wherein fastening the substantially rectangular plate on a trim includes positioning the substantially rectangular plate so a hole in the substantially rectangular plate aligns with a hole in the trim to receive a slide lock bolt.

14. A method as claimed in claim 11 wherein fastening an end of the substantially rectangular plate on the trim includes passing a screw through a hole in the substantially rectangular plate and into the trim.

15. A method as claimed in claim 11 wherein fastening the substantially rectangular plate on a trim includes positioning the substantially rectangular plate so a slide lock bolt receiving aperture in the substantially rectangular plate is aligned with a slide lock receiving hole in the trim.

16. A method as claimed in claim 15 wherein the method includes removing a plug from the slide lock bolt receiving aperture in the substantially rectangular plate by breaking connectors holding the plug in the aperture.

17. A method as claimed in claim 11 wherein fastening an end of a substantially rectangular plate on a trim over a French door includes fastening a substantially rectangular plate that has a flange having a length in a direction parallel to the length of the substantially rectangular plate that is shorter than the substantially rectangular plate and positioned centered along the length of the substantially rectangular plate.

18. An apparatus as claimed in claim 1 wherein the substantially rectangular plate has enough resilience to spring back toward its unbent position after it has been bent upward to allow the passive door to open under the flange.

19. A method as claimed in claim 11 wherein allowing the substantially rectangular plate to resiliently return toward its unbent position includes allowing the plate to spring back toward its unbent position.

* * * * *